US007443354B2

(12) United States Patent
Navarro et al.

(10) Patent No.: US 7,443,354 B2
(45) Date of Patent: Oct. 28, 2008

(54) COMPLIANT, INTERNALLY COOLED ANTENNA APPARATUS AND METHOD

(75) Inventors: Julio A Navarro, Kent, WA (US); Richard N Bostwick, North Bend, WA (US); Mark S Bolster, Fall City, WA (US)

(73) Assignee: The Boeing Company, Chicago, IL (US)

( * ) Notice: Subject to any disclaimer, the term of this patent is extended or adjusted under 35 U.S.C. 154(b) by 505 days.

(21) Appl. No.: 11/200,291

(22) Filed: Aug. 9, 2005

(65) Prior Publication Data

US 2007/0035448 A1 Feb. 15, 2007

(51) Int. Cl.
*H01Q 13/00* (2006.01)

(52) U.S. Cl. ..... 343/777; 343/853; 361/699

(58) Field of Classification Search ..... 343/777, 343/853; 361/385, 699, 285
See application file for complete search history.

(56) References Cited

U.S. PATENT DOCUMENTS

| | | | |
|---|---|---|---|
| 4,806,941 | A | 2/1989 | Knochel et al. |
| 5,008,678 | A | 4/1991 | Herman |
| 5,023,624 | A | 6/1991 | Heckaman et al. |
| 5,136,304 | A | 8/1992 | Peters |
| 5,184,141 | A | 2/1993 | Connolly et al. |
| 5,219,377 | A | 6/1993 | Poradish |
| 5,276,455 | A | 1/1994 | Fitzsimmons et al. |
| 5,434,581 | A | 7/1995 | Raguenet et al. |
| 5,488,380 | A | 1/1996 | Harvey et al. |
| 5,539,420 | A | 7/1996 | Dusseux et al. |
| 5,557,291 | A | 9/1996 | Chu |
| 5,675,345 | A | 10/1997 | Pozgay et al. |
| 5,825,333 | A | 10/1998 | Kudoh et al. |
| 5,854,607 | A * | 12/1998 | Kinghorn ..... 343/853 |
| 5,886,671 | A | 3/1999 | Riemer et al. |

(Continued)

FOREIGN PATENT DOCUMENTS

EP 0 889 542 A1 1/1999

(Continued)

OTHER PUBLICATIONS

Fitzsimmons, George W.; Lamberty, Bernie J.; Harvey, Donn T.; Riemer, Dietrich E.; Vertatschitsch, Ed J.; and Wallace, Jack E.; Publication from Microwave Journal, Jan. 1994, entitled "A Connectorless Module for an EHF Phased-Array Antenna".

(Continued)

*Primary Examiner*—Tan Ho
(74) *Attorney, Agent, or Firm*—Harness, Dickey & Pierce, P.L.C.

(57) ABSTRACT

A phased array antenna system including a mandrel having compliant portions and an internally formed cooling passageway. The compliant portions are formed by removing portions of material along one end of the mandrel to form a plurality of pairs of generally U-shaped, leaf spring-like connecting areas. The connecting areas allow a degree of movement of a lower portion of the mandrel relative to the remainder of the mandrel, when the mandrel is fixedly secured to a printed wiring board (PWB). This enables flexible electrical interconnects, positioned over the compliant portions, to make electrical contact with circuit traces on the PWB, even if the PWB has a curved or undulating surface.

18 Claims, 4 Drawing Sheets

U.S. PATENT DOCUMENTS

| | | | | |
|---|---|---|---|---|
| 5,923,289 | A | 7/1999 | Buer et al. | |
| 5,982,250 | A | 11/1999 | Hung et al. | |
| 5,990,835 | A * | 11/1999 | Kuntzsch et al. | 343/700 MS |
| 6,018,659 | A | 1/2000 | Ayyagari et al. | |
| 6,154,176 | A | 11/2000 | Fathy et al. | |
| 6,166,705 | A | 12/2000 | Mast et al. | |
| 6,211,824 | B1 | 4/2001 | Holden et al. | |
| 6,232,919 | B1 | 5/2001 | Marumoto et al. | |
| 6,249,439 | B1 | 6/2001 | DeMore et al. | |
| 6,297,774 | B1 | 10/2001 | Chung | |
| 6,297,775 | B1 | 10/2001 | Haws et al. | |
| 6,320,547 | B1 | 11/2001 | Fathy et al. | |
| 6,396,440 | B1 | 5/2002 | Chen | |
| 6,407,704 | B1 | 6/2002 | Franey et al. | |
| 6,424,313 | B1 | 7/2002 | Navarro et al. | |
| 6,429,816 | B1 | 8/2002 | Whybrew et al. | |
| 6,504,724 | B2 | 1/2003 | Serizawa et al. | |
| 6,617,510 | B2 | 9/2003 | Schreiber et al. | |
| 6,687,969 | B1 | 2/2004 | Dando | |
| 6,698,091 | B1 | 3/2004 | Heston et al. | |
| 6,700,052 | B2 | 3/2004 | Bell | |
| 6,718,815 | B2 | 4/2004 | Fantini | |
| 6,749,459 | B2 | 6/2004 | Urbaniak et al. | |
| 6,750,539 | B2 | 6/2004 | Haba et al. | |
| 6,952,345 | B2 * | 10/2005 | Weber et al. | 361/699 |
| 7,092,255 | B2 * | 8/2006 | Barson et al. | 361/699 |
| 7,110,260 | B2 * | 9/2006 | Weber et al. | 361/700 |
| 7,129,908 | B2 * | 10/2006 | Edward et al. | 343/878 |
| 7,187,342 | B2 * | 3/2007 | Heisen et al. | 343/853 |
| 2002/0003497 | A1 | 1/2002 | Gilbert et al. | |
| 2002/0018019 | A1 | 2/2002 | Fourdeux et al. | |
| 2004/0151876 | A1 | 8/2004 | Tanielian | |
| 2005/0134514 | A1 | 6/2005 | Navarro | |

FOREIGN PATENT DOCUMENTS

| | | |
|---|---|---|
| EP | 0 889 543 A2 | 1/1999 |
| EP | 0 910 134 A2 | 4/1999 |
| EP | 1 094 541 A2 | 4/2001 |
| EP | 1 381 083 | 1/2004 |
| JP | 10-270935 | 9/1998 |
| WO | WO 99/34477 | 7/1999 |
| WO | WO 00/39893 | 7/2000 |
| WO | WO 02/09236 A2 | 1/2002 |
| WO | WO 02/23966 | 3/2002 |

OTHER PUBLICATIONS

International Search Report dated Oct. 25, 2004 re International Application No. PCT/US2004/022808.

H. Wong et al.; an EHF Backplate Design for Airborne Active Phased Array Antennas; Hughes Aircraft Company; El Segundo, CA; pp. 1253 & 1256; 1991 IEEE.

Wallace, Jack; Redd, Harold; and Furlow, Robert; "Low Cost MMIC DBS Chip Sets for Phased Array Applications," IEEE, 1999, 4 pages.

Rogers Corporation Data Sheet, "RD/duroid®5870/5880 High Frequency Laminates", Mar. 2003, 4 pgs.

* cited by examiner

COMPLIANT, INTERNALLY COOLED ANTENNA APPARATUS AND METHOD

FIELD OF THE INVENTION

The present invention relates to phased array antenna systems, and more particularly to a longitudinally compliant, internally cooled phased array antenna system in which a cooling medium is flowed through an interior area of a core component to cool the core component and other electronic components supported on the core component.

BACKGROUND OF THE INVENTION

Phased array antennas are used in a variety of commercial and military applications. Typically, these antennas include hundreds of transmit/receive radiating elements that are supported adjacent one surface of a core component. Typically, the core component is made from a thermally conductive material such as aluminum. Also supported on the core component is a plurality of ceramic chip carrier boards that support a plurality of monolithic microwave integrated circuits (MMICs), phase shifters and other components. These components generate heat which is radiated through thermally conductive standoffs that are used to support the ceramic chip carrier boards closely adjacent the core component. In previously developed systems, the core component itself is supported on a cold plate. The cold plate has internally formed channels or tubes integrally formed with it to circulate a fluid through the cold plate. The fluid helps to draw heat from the core component, which in turn enables the ceramic chip carrier boards to be cooled.

While the above arrangement has proven to be successful in many applications, it would nevertheless be desirable to provide even more efficient cooling of the ceramic chip carrier and its components. Increased cooling ability is expected to become important as phased array antennas support even greater numbers of radiating elements and associated MMICs, phase shifters, etc., that will generate even greater amounts of heat that will need to be dissipated.

Thus, there remains a need to even further improve the cooling of a phased array module using a cooling medium, but which does not significantly complicate the construction of a phased array antenna, nor which limits the number of radiating/reception elements that may be employed or otherwise interferes with mounting of the ceramic chip carrier boards on a module core component.

SUMMARY OF THE INVENTION

The present invention is directed to a phased array antenna system in which a cooling medium is circulated through an elongated core component of the system to even more efficiently cool the electronic components of the antenna system during use. The core component also includes a leaf spring-like structure formed at a lower portion of the core component that allows the lower portion to flex slightly, relative to the remainder of the core component, when the core component is secured to a printed wiring board subassembly. This enables excellent electrical contact to be maintained with the printed wiring board subassembly along the full length of the core component.

In one preferred implementation the core component forms an elongated mandrel having both a cooling medium carrying channel formed inside, as well as a hollowed out area for allowing air to circulate within the inside area of the mandrel. The core component has a length sufficient to support a plurality of electronic component boards in side-by-side fashion, on opposing side surfaces of the mandrel.

In one preferred implementation the core component is formed from a solid block of aluminum. The leaf spring-like structure is formed by removing material from an interior area of the mandrel, as well as from opposing side portions, such that a plurality of U-shaped leaf spring-like sections of material are formed. The U-shaped leaf spring-like sections of material enable one end portion of the mandrel to be compliant and thus to flex slightly along its length as the mandrel is secured to a printed wiring board. A multi-layer flexible interconnect circuit assembly is coupled to the one end of the mandrel. The compliant section of the mandrel ensures that the multi-layer flexible interconnect circuit assembly makes excellent contact with conductive traces on a printed wiring board, along its full length, once the mandrel is secured to the printed wiring board. This ensures electrical communication between contacts on the printed wiring board and circuit traces formed on the flexible interconnect circuit assembly.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
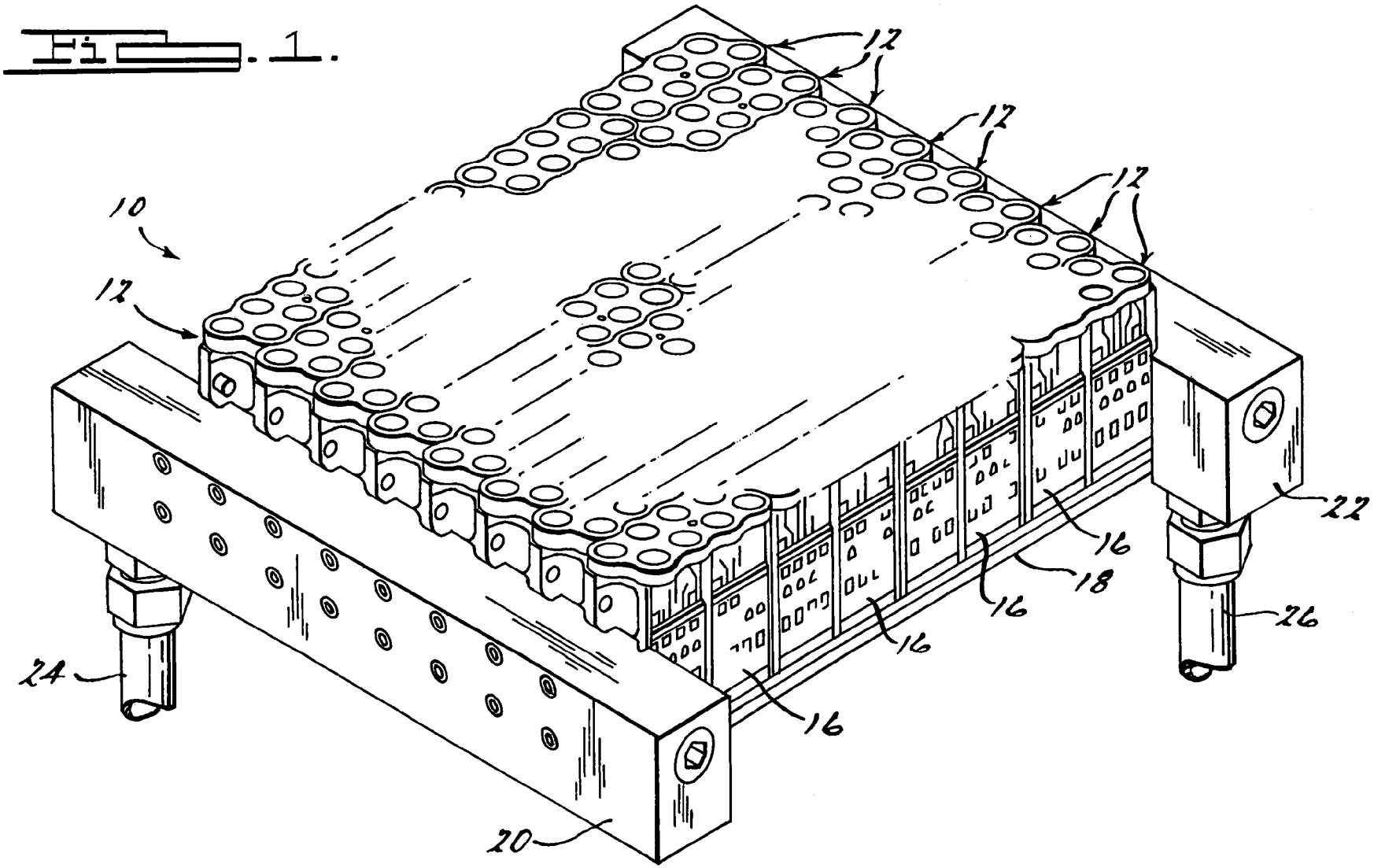
FIG. 1 is a perspective view of a preferred embodiment of an antenna system in accordance with the present invention.

Referring to FIG. 1, an antenna system 10 in accordance with the preferred embodiment of the present invention is shown. The antenna system 10 is illustrated as a phased array antenna system having a plurality of identical antenna module rows 12, each of which comprises a plurality of eight element phased array antenna modules 16 supported on a printed wiring board 18. Thus, each antenna module row 12 has 32 elements. Each module row 12 is coupled at opposite ends to a pair of manifolds 20 and 22. Manifold 20 forms an input manifold that carries a cooling medium, for example a fluid such as water, an inert gas, or any other flowable medium capable of drawing heat from the module rows 12, from a supply conduit 24 to supply the cooling medium to each module row 12. Manifold 22 forms an output manifold that collects the cooling medium flowing through each module row 12 and returns the cooling medium to a radiator, heat exchanger or supply source coupled to conduit 26. In this manner, the cooling medium flowing through each module row 12 is used to cool the electronic components on each of the modules 16. This provides even more efficient cooling of the electronic components on each antenna module 16. While only eight module rows 12 are shown, a greater or lesser number of module rows 12 could be implemented to suit the needs of a specific application. In the example embodiment of FIG. 1, the system 10 forms a 256 element phased array antenna.

Figure 2:
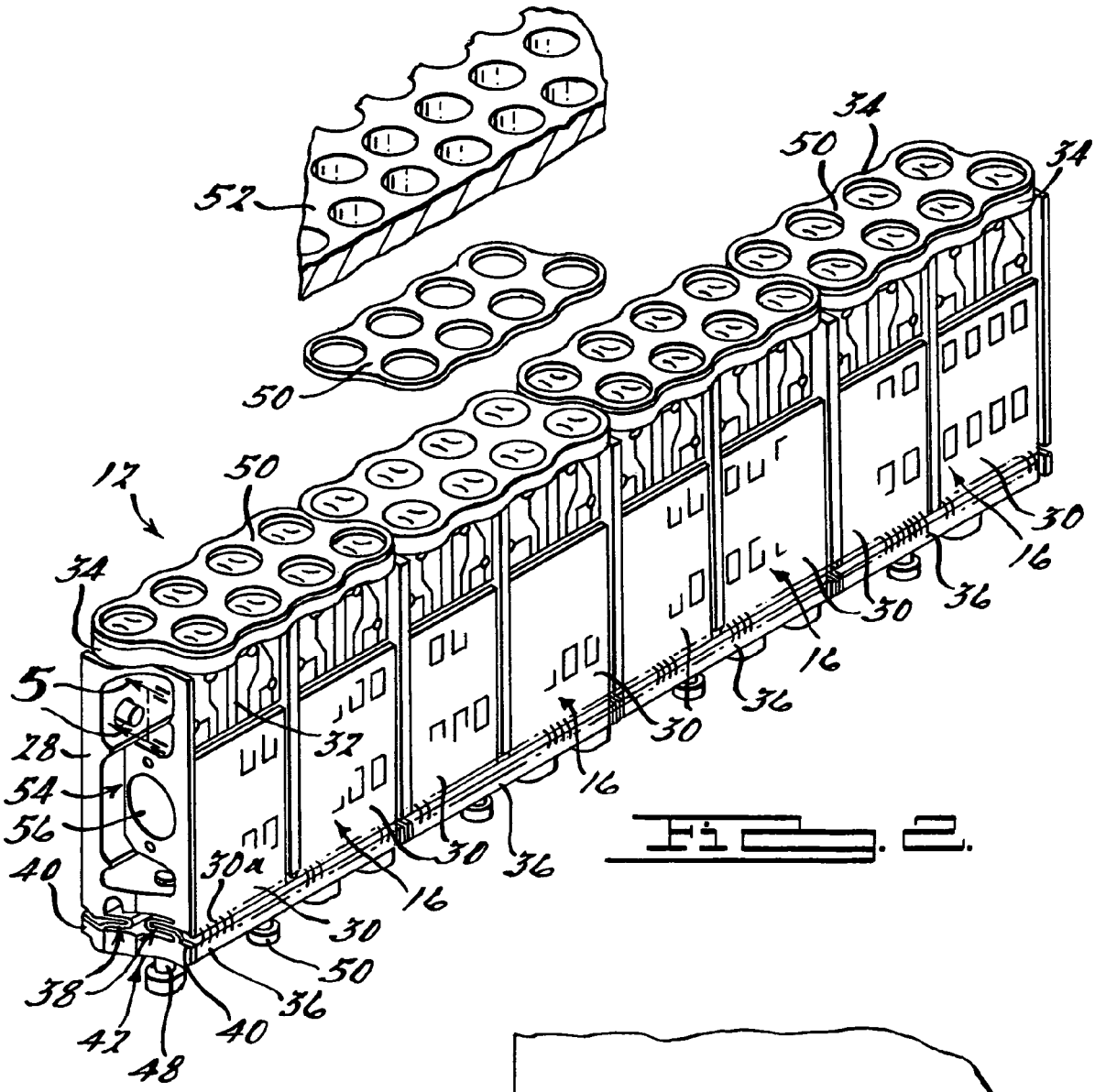
FIG. 2 is a partially exploded perspective view of one module row of the antenna of FIG. 1.

Referring to FIG. 2, one module row 12 is shown in a partially exploded prospective fashion. The printed wiring board 18 has been omitted to better illustrate the structure of the antenna modules 16.

Figure 3:
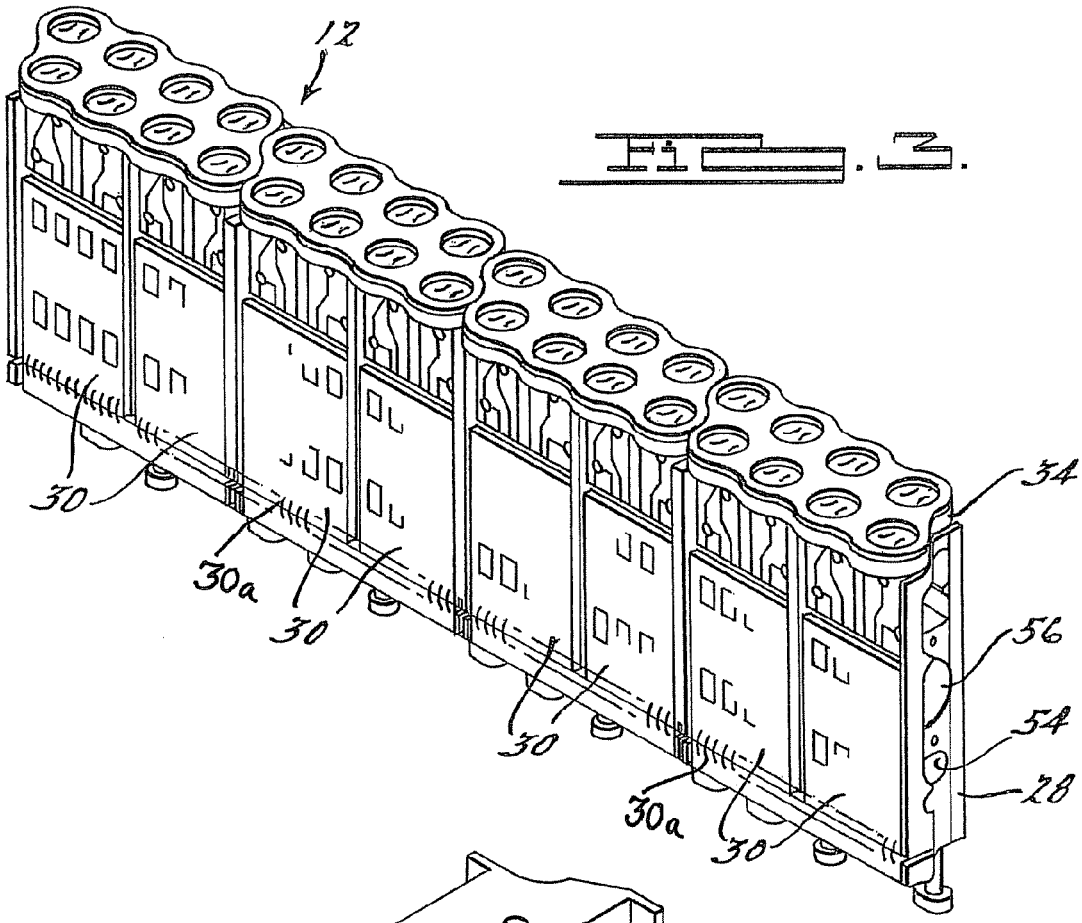
FIG. 3 is a view of the opposite side of the module row of FIG. 2.
Figure 4:
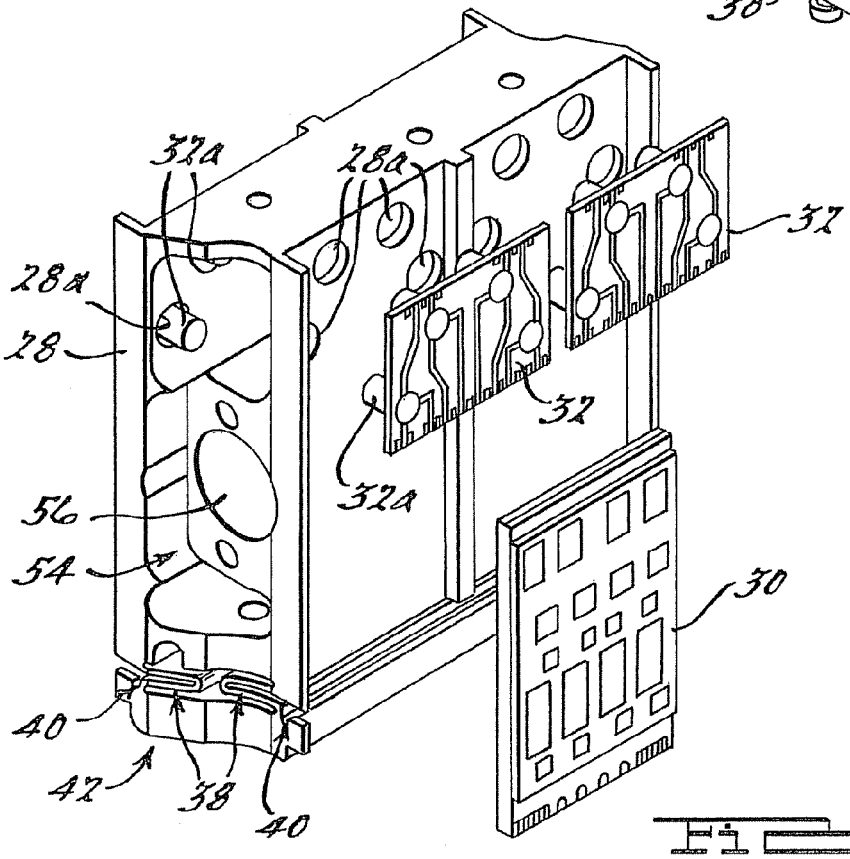
FIG. 4 is an exploded perspective view of a portion of the module row of FIG. 3.

Referring to FIGS. 2-4, each module row 12 is formed by an elongated, thermally conductive core component in the form of a metallic mandrel 28 having a plurality of components supported thereon in thermal communication with the mandrel 28 (FIGS. 2 and 3). In one preferred form, the mandrel 28 is formed by a single piece of aluminum stock. The mandrel 28 supports a plurality of ceramic chip carrier assemblies 30 adjacent one another along one side surface of the mandrel 28, and a corresponding plurality of chip carrier component assemblies 30 on an opposing side surface of the mandrel 28 (FIG. 3). A plurality of conventional circulator assemblies 32 are also disposed on each side of the mandrel 28. Each circulator assembly 32 is associated with a single one of the chip carrier assemblies 30. Eight element antenna integrated printed wiring boards (AIPWBs) 34 are disposed on an upper surface of the mandrel 28 (FIG. 4). Four flexible interconnect circuit assemblies 36 are secured at a lower end of the mandrel 28 and are electrically coupled to the ceramic chip carrier assemblies 30 using conventional wire bonds 30*a*. Each flexible interconnect circuit assembly 36 may be secured by bonding, as generally described in U.S. application Ser. No. 10/991,291, filed Nov. 17, 2004, and assigned to the Boeing Company, and incorporated by reference herein. Each AIPWP 32 provides eight dual polarization radiating elements, as well as an interface to DC logic and power subsystems (not shown) associated with the antenna.

Figure 5:
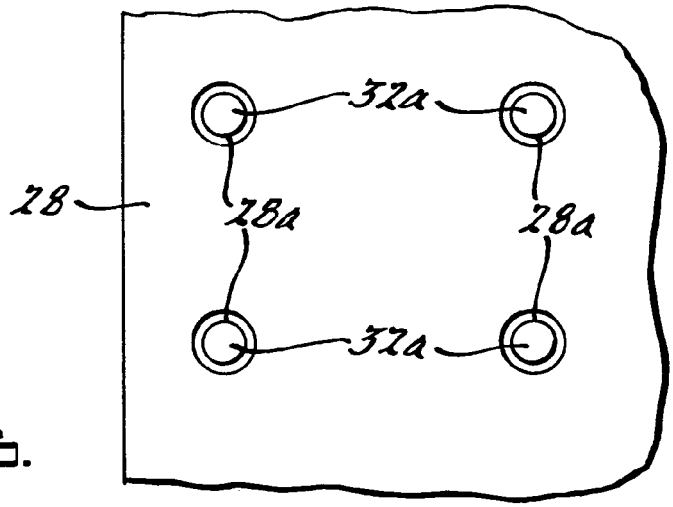
FIG. 5 is a plan view of a portion of the mandrel in accordance with arrows 5 in FIG. 2.
Figure 7:
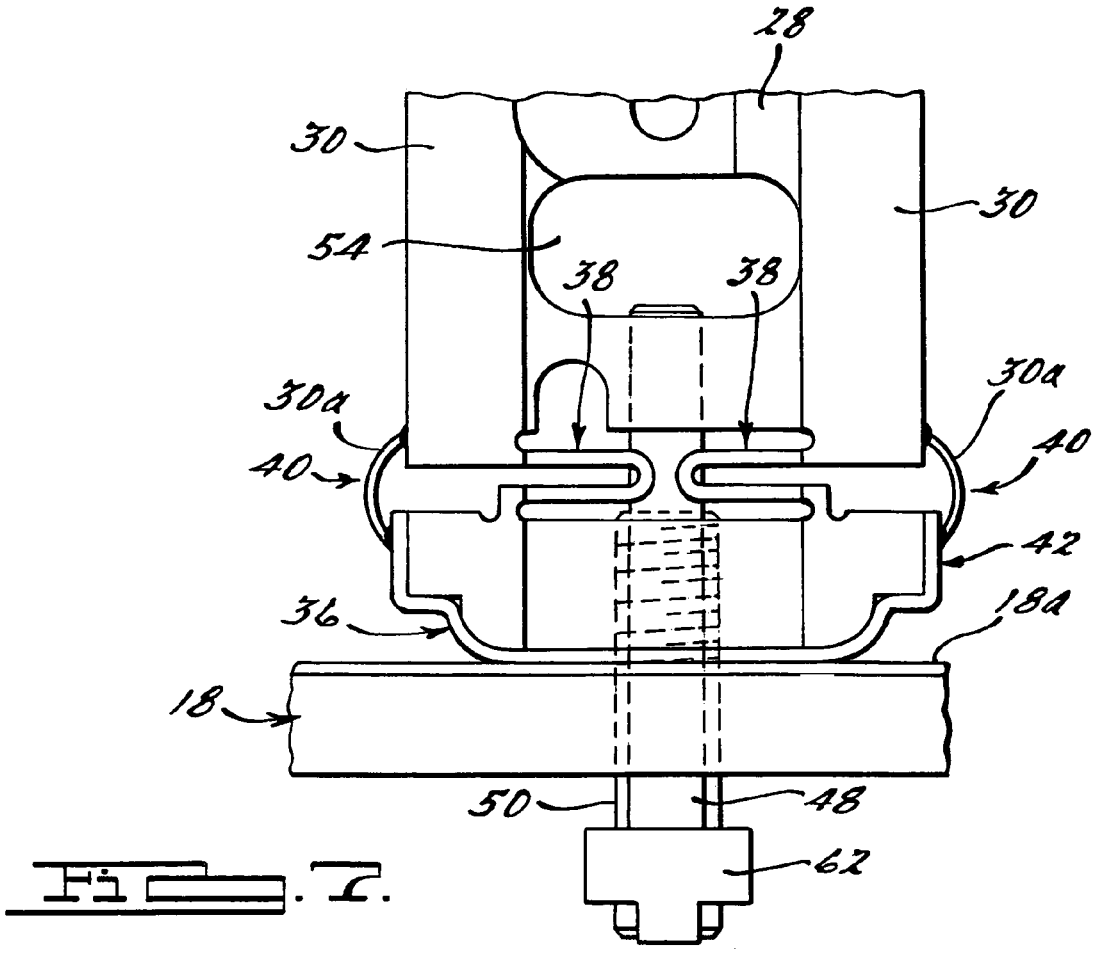
FIG. 7 is an end view of a portion of the module row of FIG. 2.

Referring to FIGS. 2, 5 and 7, it is a principal advantage of the antenna system 10 that each mandrel 28 includes a pair of leaf spring-like structures 38 formed at a lower end thereof. The leaf spring-like structure 38 is formed by removing material on the interior area of the mandrel 28, as well as along lower exterior side portions 40 of the mandrel, so that the material left forms a generally sideways-facing U-shaped structure. Cut-outs 46 are also formed along the lower side portions 40 of the mandrel 28 such that a plurality of independently compliant sections 47 are formed on the mandrel 28. When the mandrel 28 is secured to the printed wiring board 18 (FIG. 1) via fastening elements 48 and 50 (FIGS. 2 and 7), the entire length of the lower surface portion of the mandrel 28 can be held securely against the printed wiring board 18. This eliminates the possibility of undulations in the surface of the printed wiring board 18, or a slight curvature or undulations of the mandrel 28, from preventing electrical content from being made between surface traces on the printed wiring board 18 and the flexible interconnect circuit assemblies 36, at one or more points along the length of the mandrel 28.

With further reference to FIGS. 2 and 3, the AIPWBs 34 may be formed in accordance with the teachings of U.S. patent application Ser. No. 10/200,088, filed Jul. 19, 2002; U.S. Pat. No. 6,670,930, issued on Dec. 30, 2003; and U.S. Pat. No. 6,580,402, issued on Jun. 17, 2003, each of which are hereby incorporated by reference into the present application, and each of which are assigned to The Boeing Company.

The circulator subassemblies 32 each comprise four channel open (i.e., quad) circulators that are commercially available. The circulator subassemblies 32 are in electrical communication with associated ceramic chip carrier subassembly boards 30. Referring to FIGS. 2 and 5, each circulator subassembly 32 includes four permanent magnets 32*a* that project through four corresponding holes 28*a* in the mandrel 28. Thus, there are 16 circulators for each eight element antenna module 16.

Referring further to FIG. 2, each AIPWB 34 is positioned against a conventional, mechanically compliant spring assembly 50 that forms a thin, conductive layer for making electrical contact with a conventional honeycomb wave guide component 52 that covers each of the AIPWBs 34. Alignment pins 52 (not shown) projecting from the mandrel 28 through each of the AIPWBs 34 enable precise positioning of the honeycomb wave guide 52 and the spring assembly 50 over each of the AIPWBs 34.

Referring further to FIGS. 2 and 3, the mandrel 28 includes a hollowed-out area 54 and a cooling medium passageway 56. Fastening elements 48 and 50 form attachment posts that can be threaded into openings 60 (in FIG. 6) in the mandrel 28 to enable attachment of the mandrel 28 to the printed wiring board 18. Threaded nuts 62 (FIG. 7) may be used to accomplish securing of the mandrel 28 to the printed wiring board 18.

While the mandrel 28 of FIGS. 2 and 3 is illustrated as a single section of metallic material, the mandrel 28 could just as readily be formed in two or more sections that are secured together to form an elongated subassembly. However, forming the mandrel 28 from a single length of material eliminates the need for using seals, gaskets, etc., that would otherwise be needed to seal two or more sections of the mandrel together to ensure that the cooling medium flowing through the entire mandrel does not leak at the interfaces of adjacent mandrel sections. The compliant leaf spring-like structures 38 enable a single, elongated length of material to be used while still permitting each module section 16 to be secured flush against the outer surface of the printed wiring board 18.

Each of the ceramic chip carrier boards 30 are preferably secured via thermally conductive adhesive to the mandrel 28. Suitable electrically conductive adhesives are commercially available.

Figure 6:
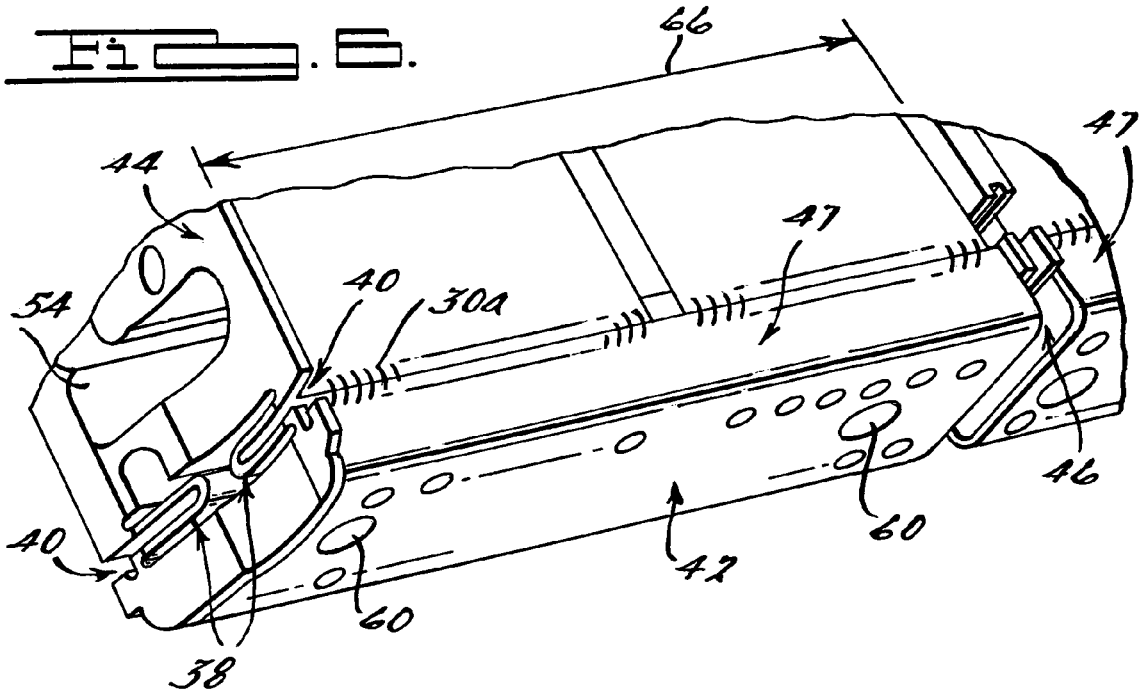
FIG. 6 is a perspective view of a lower portion of the module row of FIG. 2 with the fasteners omitted.

Referring further to FIG. 6, a bottom surface of the mandrel 28 can be seen in greater detail. The depth of each slot 46 extends upwardly past the U-shaped leaf spring-like structures 38. Thus, the slots 46, in combination with the leaf spring-like structures 38, enable the length designated by dash line 66, representing one compliant section 47, to flex independently of adjacent compliant sections 47 along the length of the mandrel 28 when the mandrel 28 is secured to the printed wiring board 18.

Referring further to FIG. 7, the mandrel 28 is shown clamped securely down to the printed wiring board 18. The flexible interconnect circuit 36 makes electrical contact with traces on the upper surface 18*a* of the printed wiring board 18. The flexing of the lower portion 42 of the mandrel 28 does not affect the flow of the cooling medium through the passageway 56, since each compliant portion 47 of the mandrel 28 is independently secured to the printed wiring board 18. The mandrel 28 can form slight undulations or a slight curvature along its length that conforms to undulations and/or a slight curvature of the printed wiring board 18, to thus ensure that full contact is made along the entire length of the flexible interconnect circuit 36 and the upper surface 18*a* of the printed wiring board 18.

The system 10 of the present invention thus enables an elongated core component of a phased array antenna module to be secured along its full length to a printed circuit assembly while ensuring that proper electrical contact is made along the full length of the core component with the printed wiring board to which it is secured. The internal cooling passageway incorporated into the mandrel 28 allows even more efficient cooling of the ceramic chip carrier boards used with phased array antenna systems, since the cooling medium is flowed very close to the source of the heat being generated in the module (i.e., the ceramic chip carrier boards). The use of a single length of thermally conductive material (for example, aluminum) to form the mandrel further eliminates the need for seals or gaskets to be employed, if the mandrel was to be formed in two or more independent sections and then secured together to form a single mandrel assembly.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. An antenna system comprising:

an elongated mandrel for supporting a plurality of electronics subassemblies;

the mandrel having material removed at one end to form a plurality of leaf spring like sections;

each said leaf spring like section enabling a subsection of the mandrel to be able to flex relative to other subsections such that the mandrel forms a conformable support member that can be secured to an external electrical component and conform to a surface curvature of the external electrical component.

2. The antenna system of claim 1, wherein said leaf spring like sections form opposing U-shaped leaf spring like sections along a common end of said mandrel.

3. The antenna system of claim 2, wherein said leaf spring like sections further define cut-outs; and said antenna system further including at least one flexible electrical interconnect assembly that is disposed over said end of said mandrel.

4. The antenna system of claim 3, wherein the mandrel comprises a length of metallic material having a hollowed out portion for receiving a flowing cooling medium to cool the mandrel.

5. The antenna system of claim 4, wherein the mandrel further comprises a hollowed area adjacent the hollowed out portion for allowing air flow circulation through the mandrel.

6. The antenna system of claim 5, further comprising an antenna integrated printed wiring board having a plurality of radiating elements mounted to a surface of said mandrel opposite said end along which said leaf spring like sections are formed.

7. An antenna system comprising:

an elongated mandrel for supporting a plurality of electronic printed wiring boards along a side portion thereof;

the mandrel having material removed at opposing sides of one end to form a plurality of leaf spring like sections along a length thereof;

each said leaf spring like section enabling a subsection of the mandrel to be able to flex relative to other subsections such that the mandrel forms a conformable support member that can be secured to an external electrical component and conform to a surface curvature of the external electrical component; and the mandrel further including a fluid passageway for enabling a cooling medium to be circulated through the mandrel to assist in cooling the mandrel during operating of the antenna system.

8. The antenna system of claim 7, further comprising a plurality of electronic printed wiring boards secured to opposite side surfaces of the mandrel and in thermal communication with the mandrel.

9. The antenna system of claim 7, further comprising a plurality of antenna wiring boards each having a plurality of radiating elements, and being supported on a surface of said mandrel opposite to said one end, and in electrical communication with an associated one of said electronic printed wiring boards.

10. The antenna system of claim 7, further comprising a flexible interconnect assembly supported on said one end of said mandrel for enabling electrical communication with an external electrical circuit component.

11. A method for forming a phased array antenna, the method comprising:

forming a metallic material into an elongated support mandrel;

forming a hollowed area in the mandrel;

forming a pair of longitudinally extending opposing slots, in sections, at one end of the metallic mandrel, and along a length of the mandrel such that a plurality of independent, flexible sections are formed along one end of the metallic mandrel that enable the metallic mandrel to generally conform to, and to be secured to, an undulating electrical component while making electrical contact with said undulating electrical component along substantially an entire length of said one end of the metallic mandrel; and securing a plurality of electronic components to side surfaces of the metallic mandrel.

12. An antenna system comprising:

a thermally conductive core component, the core component having an internal flow passage for flowing a cooling medium therethrough;

an electronic component supported from the core component in a manner to transmit heat generated by the electronic component to the core component; and a cooling medium in communication with the core component for circulating through the internal flow passage of said core component to absorb and carry away heat absorbed by the core component, to thus cool the electronic component.

13. The system of claim 12, further comprising:

a core component having material removed from one end thereof to form a compliant end portion defined by at least one slot;

a flexible electrical circuit interconnect disposed at least partially within the slot, and in electrical communication with said electronic component; and a printed wiring board in communication with said flexible electrical circuit interconnect.

14. The system of claim 13, wherein said one end of said core component includes a plurality of slots for defining a plurality of distinct compliant end portions.

15. The system of claim 12, wherein said core component comprises an elongated component for supporting a plurality of electronic components in side by side fashion therefrom.

16. The system of claim 12, wherein said core component further includes a plurality of secondary internal passages for permitting airflow therethrough.

17. The system of claim 12, wherein said core component is comprised of a single piece of aluminum.

18. An antenna system comprising:

a thermally conductive core component, the core component having an internal flow passage for flowing a cooling medium therethrough;

an electronic component supported from the core component in a manner to transmit heat generated by the electronic component to the core component;

a cooling medium in communication with the core component for circulating a cooling medium through the internal flow passage of said core component to absorb and carry away heat absorbed by the core component, to thus cool the electronic component;

a first manifold portion coupled to a first side of said core component for supplying said cooling medium into said core component; and a second manifold portion for receiving said cooling medium after said cooling medium has circulated through said core component.

* * * * *